United States Patent [19]

DeWeese

[11] 4,013,312

[45] Mar. 22, 1977

[54] LATCH MECHANISM FOR SELF-CLEANING OVEN

[75] Inventor: Raymond Paul DeWeese, Kankakee, Ill.

[73] Assignee: Roper Corporation, Kankakee, Ill.

[22] Filed: Dec. 5, 1975

[21] Appl. No.: 638,185

[52] U.S. Cl. ..... 292/113; 292/DIG. 69; 126/197

[51] Int. Cl.[2] ..... E05C 5/00

[58] Field of Search ..... 292/DIG. 69, 240, 241, 292/66, 67, 113; 126/197; 219/10.55 C, 10.55 D, 398, 413

[56] References Cited

UNITED STATES PATENTS

| | | | |
|---|---|---|---|
| 3,540,767 | 11/1970 | Siegel | 126/197 |
| 3,642,313 | 2/1972 | Anderson | 292/113 |
| 3,733,456 | 5/1973 | Blackburn | 219/10.55 C |
| 3,750,643 | 8/1973 | Fowler et al. | 292/DIG. 69 |
| 3,776,216 | 12/1973 | Pirker et al. | 126/197 |
| 3,815,942 | 6/1974 | White | 292/113 |
| 3,859,979 | 1/1975 | Gilliom | 292/DIG. 69 |

*Primary Examiner*—Robert A. Hafer
*Attorney, Agent, or Firm*—Leydig, Voit, Osann, Mayer & Holt, Ltd.

[57] ABSTRACT

A door latch assembly for a pyrolytic self-cleaning oven which includes a locking plate and a bolt cooperating with a striker on the oven door. A slot adjacent the locking plate communicates with spaced-apart shallow and deep notches. A locking finger is shiftable in the slot and biased toward the notches, the finger having an actuator for drawing it into shiftable position in the slot clear of the notches. A first abutment is provided on the locking plate having a path of movement alined with the slot but clear of the notches so that when the actuator is de-energized and the finger occupies an idle position in the shallow notch, the locking plate and bolt are freely movable by an operating handle between free and bolting positions and so that, when the actuator is energized and the locking plate moves fully into bolting position, the first abutment moves the finger to a position opposite the deep notch. A second abutment is provided on the locking plate faced oppositely to the first abutment and having a path of movement alined with the root of the deep notch so that when the actuator is de-energized the finger drops into the deep notch, securely blocking the locking plate, and thus the bolt, in bolting position. A third abutment returns the finger to idle position following re-energization of the actuator.

8 Claims, 9 Drawing Figures

66
10
71
65
61
53
42
75
62
74
77
36
37
40
91
35
51
90
50
32
30
34
33
20
41
21
23
31
18
17
16
31
33
30
10
23
11
35
36
22
19
14
12
13
15

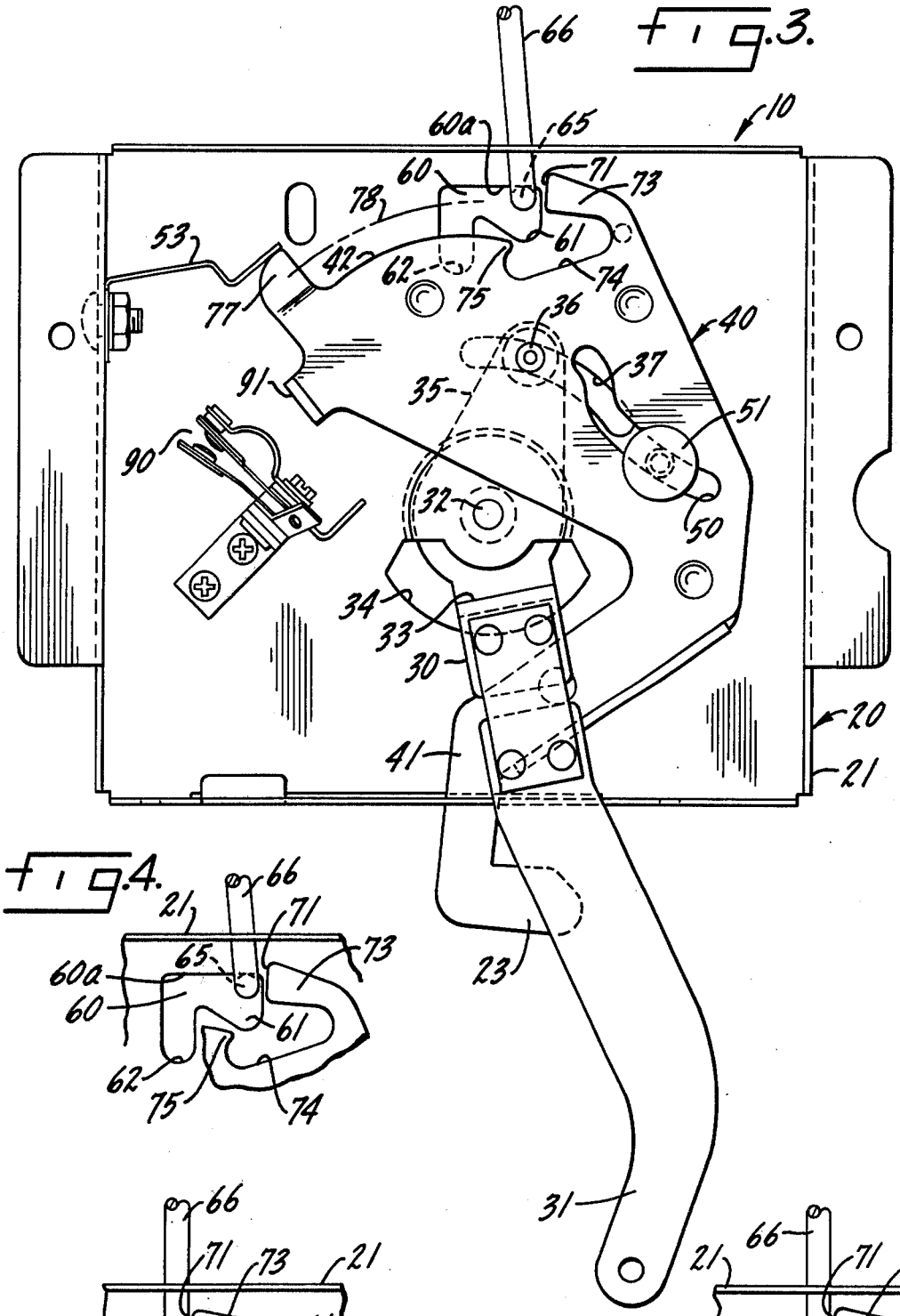
fig.3.
fig.4.
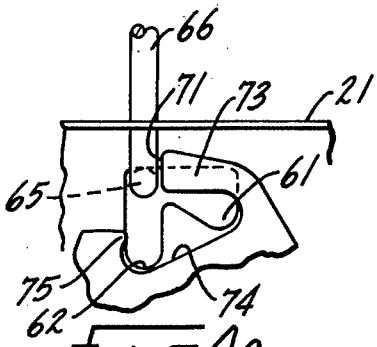
fig.4a.
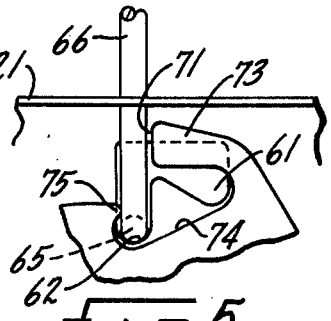
fig.5.

LATCH MECHANISM FOR SELF-CLEANING OVEN

In self-cleaning ovens of the pyrolytic type it is necessary to maintain the oven door locked in closed position during the time that the high self-cleaning temperature is effective, and numerous designs of latches, of varying complexity, have been devised for this purpose. The control system associated with the latch often includes a disabling means which prevents opening of the oven door as long as a high temperature exists in the oven cavity. In one system of control a lock/unlock pushbutton is provided which must be depressed to place the mechanism in its locking mode and prior to swinging the operating lever to locking position. After the cleaning cycle has been completed and the temperature has been restored to a safe level, pressing the button again permits the operating lever to be swung back to its free or unlocking position to free the door and to restore the range to normal usage.

It is an object of the present invention to provide a door latch assembly which is of extremely simple construction and which is safe and reliable, requiring affirmative action on the part of the user to place the assembly in a locking mode and capable of maintaining the assembly in its positively locked condition as long as the temperature within the oven cavity is above a predetermined level.

It is another object of the invention to provide a door latch assembly which is economical to construct, which operates freely yet positively over the life of the range with no tendency toward sticking in one position or the other by reason of the gummy residue which may be condensed on the mechanism as a result of heavy usage of the oven over a period of years. In this connection it is an object to provide a door latch assembly which does not rely upon differential sliding of adjacent moving elements and which does not rely upon internal springs for restraining one element with respect to another, inviting misfunction. Indeed, it is an object of the present invention to provide a latch assembly which is versatile in operation but which is formed of a minimum number of moving parts, in the preferred embodiment only two moving parts in addition to the manual operating handle, resulting in smooth trouble-free operation.

It is yet another object of the invention to provide a latching assembly which is particularly well suited for "common cavity" ovens which, in addition to self-cleaning capability, include a source of microwave energy, with the throwing of the operating handle to latched position serving to maintain the oven door closed as long as a microwave field exists in the cavity.

Other objects and advantages of the invention will be apparent upon reading the attached detailed description and upon reference to the drawings in which:

FIG. 1 is a plan view of a door latch assembly with its associated actuator and rudimentary control circuitry with the operating lever shown in the conventional baking and broiling mode.

FIG. 1*a* is a vertical cross section showing the latch assembly as installed in a range and looking along the line 1*a*—1*a* in FIG. 1.

FIG. 3 is a stop motion view showing the assembly condition for locking in the pyrolytic (self-cleaning) mode and with the operating lever partially swung to bolting position.

FIGS. 4 and 4*a* are fragmentary views showing the shifting of the locking finger upon completion of the bolting stroke with the solenoid energized.

FIG. 5 is a fragmentary view showing the effect of de-energization of the solenoid which locks the mechanism in bolting position.

Figures 1, 6, 6A:
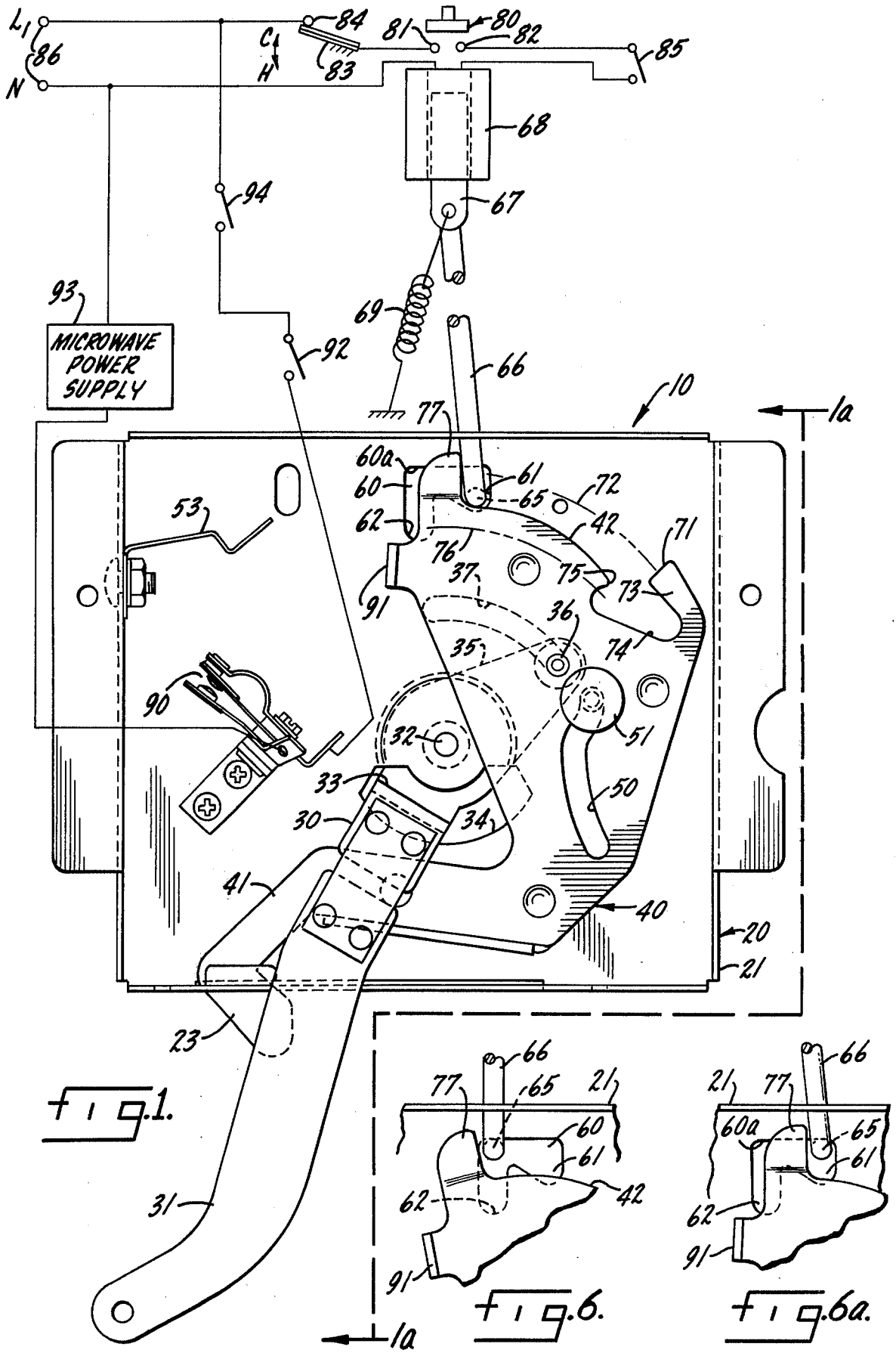

FIGS. 6 and 6*a* are fragmentary stop motion views showing the shifting of the locking finger from locking back to idle position following re-energization of the solenoid.

While the invention has been described in connection with the preferred embodiment, it will be understood that I do not intend to limit the invention to the particular embodiment which has been illustrated but intend, on the contrary, to cover the various alternative and equivalent constructions included within the spirit and scope of the appended claims.

Figures 1A, 2:
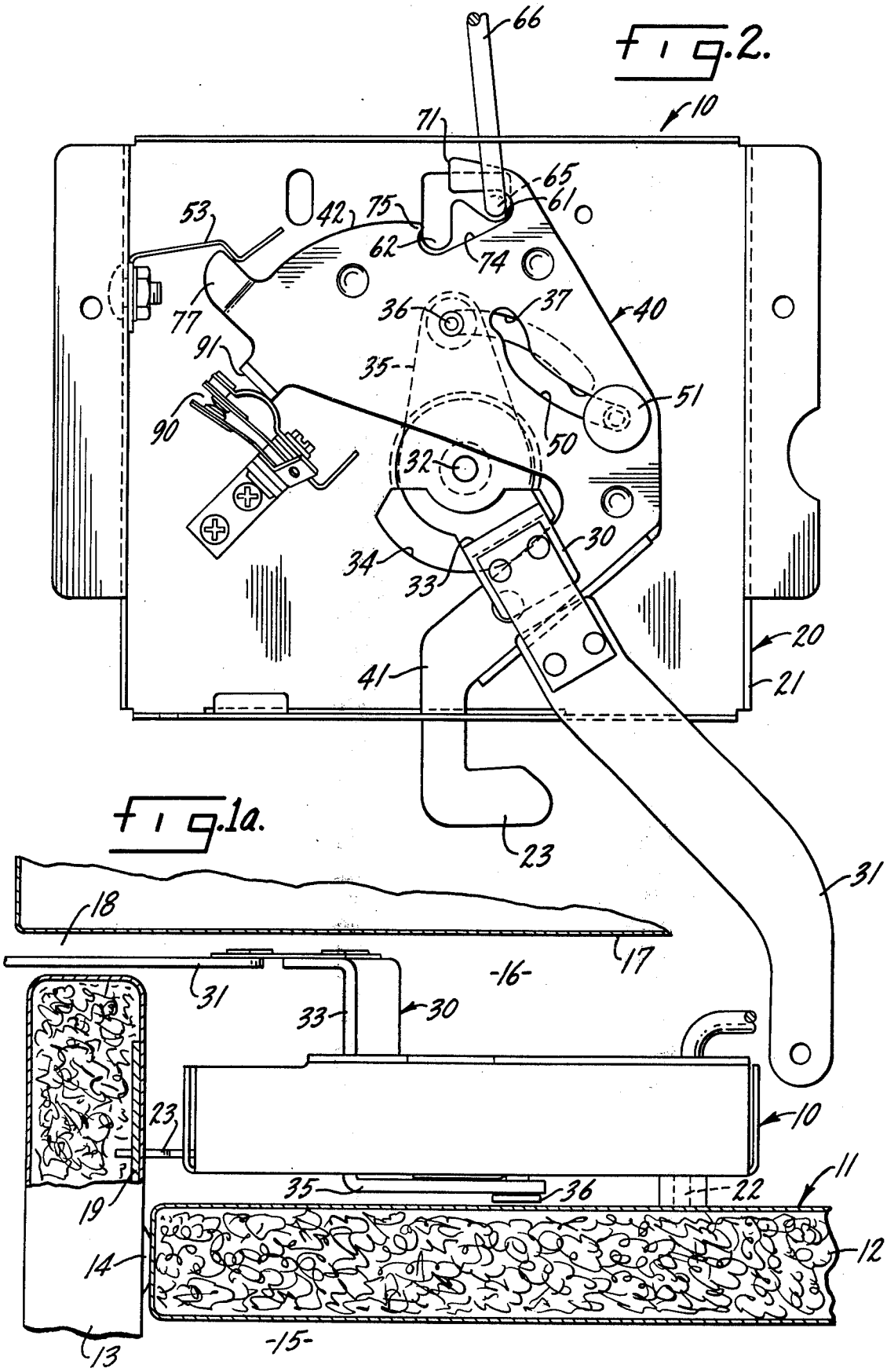
FIG. 2 shows the assembly with the operating lever thrown to locking position, with the oven door latched, but not locked, for microwave and common cavity cooking modes.

Turning now to the drawings there is shown in FIGS. 1 and 1*a* a latch assembly 10 mounted in a range having a frame 11 (only fragmentarily shown) in which an insulated top wall 12 and an insulated door 13, having a gasket 14 between them, serve, in part, to define an oven cavity 15 having the usual heating elements and which may, in addition, be provided with a source of microwaves. The door 13 is extended slightly above the oven wall 12 to form a head space 16 which is enclosed by upper structure 17 defining an access slot 18 at the upper edge of the door. Accessible within the upper end of the door structure is a striker 19. It will be understood that hinges (not shown) are provided at the lower edge of the door.

The preferred embodiment of the door latch assembly is conveniently contained on a rectangular mounting plate 20 of shallow boxy shape having upturned edges 21. Screws 22 serve to secure the mounting plate to the oven frame. Extending forwardly from the mounting plate is a bolt 23 of hook shape which is shown, in FIG. 1, in its free or retracted position but which is outwardly swingable through an access opening in the door structure into captive engagement with the keeper 19 in the door to latch the door in closed position.

Extending through the slot 18 at the top of the door is an operating lever 30 having a handle 31 and pivoted at 32 to the underside of the frame plate, the forward end of the lever being offset downwardly at 33 and passing through an arcuate opening 34 in the plate. The remote end of the lever, indicated at 35, carries a pin 36 which extends upwardly through the mounting plate through an arcuate clearance opening 37.

Bodily movable on the upper surface of the mounting plate is a locking plate 40 which is connected to the pin 36 on the operating lever. The locking plate is coupled to the bolt 23 for movement in unison, in the present instance the bolt 23 being integral with the locking plate and secured to the front edge of the latter upon an integral neck or extension 41.

In carrying out the invention the motion of the locking plate is modified by interposing, between the mounting plate 20 and the locking plate, a cam and cam follower so that, as the operating lever 30 is manually swung from its free position to its bolting position, the locking plate swings the bolt to a position against the striker and then pulls the bolt inwardly upon the striker so as to close the door tightly, with pressure being applied continuously about the gasket 14. The gasket 14 is resilient and provides electrical as well as thermal gasketing where microwave energy is employed. This modification of movement is very simply accomplished by forming a cam slot 50 of doglet shape in the locking plate, the cam slot engaging a follower in the form of an upstanding post 51 which is stationary on the mounting plate.

For detenting the mechanism in its bolting position (FIG. 2), a detent spring 53 is secured on the mounting plate in the path of movement of the locking plate.

In accordance with the invention there is formed in the mounting plate, adjacent the rear edge 42 of the locking plate, a short transversely extending slot 60, the slot being oriented in the direction of movement of the adjacent rear edge portion of the locking plate. The slot has, in communication with it, a shallow "idle" notch 61 and a relatively deep "locking" notch 62, the notches being spaced parallel to one another at right angles to the slot 60.

Shiftable in the slot 60 is a locking finger, or pawl, 65 which is formed by the bent-over end portion of a locking rod 66 which is coupled to the armature 67 of a solenoid 68 having a return spring 69. As long as the solenoid is de-energized, the spring 69 serves to bias the finger 65 in the direction of the notches 61, 62. The notch in which the finger 65 seats is dependent upon the shifted position of the finger 65 along the slot 60. When the solenoid is energized the finger 65 is drawn toward the straight edge 60*a* of the slot 60, in which position the finger is freely shiftable.

In carrying out the present invention the locking plate is provided with a first abutment having a path of movement which is alined with the slot but which is clear of the notches so that, when the actuator is de-energized and the finger occupies an idle position in the shallow notch, the locking plate and bolt are freely movable by the operating handle between free and bolting positions. The first abutment, indicated at 71 follows a path of movement indicated by the dot-dash line 72 which, it will be seen, is alined with the slot 60. The abutment 71 is at the end of an ear or tang 73 which is defined by a cutout 74, the cutout permitting the abutment to swing clear of the notches 61, 62. Thus when the finger 65 occupies the shallow notch 61, as illustrated in FIG. 2, it is possible to move the operating lever 30 smoothly between its free and bolting positions, the abutment 71 swinging idly beyond the radius of the finger which is accommodated by the cutout 74.

However when the finger 65 is drawn out of the notch 61 and into the slot 60, the finger becomes alined with the path of movement of the abutment 71, as illustrated in FIG. 3, which shows the operating lever 30 swung through approximately 70% of its total arc of swing. The movement which occurs during the completion of the swing is illustrated in FIGS. 4 and 4*a*. FIG. 4 shows that upon completion of the stroke the finger 65 is shifted to a position opposite the deep notch 62.

Further in accordance with the invention a second, or locking, abutment is provided on the locking plate faced oppositely to the first abutment and having a path of moement which is alined with the root of the deep notch 62 so that when the actuator is de-energized the locking finger drops, by reason of the force of bias of the spring 69, into the deep notch, with the finger, in such position, blocking the second abutment and making it impossible to restore the operating lever to its free, non-latching position. In the preferred embodiment the second abutment 75, oriented in a direction opposite to the abutment 71, follows a path of movement 76 which is alined with the root of the notch 62. It will be noted that the second abutment 75 is angularly deepened, or hooked (to the left as shown), so that the finger 65 is certain to be held captive in the deep notch thereby to hold the locking member securely in the bolting position illustrated in FIG. 5.

As a further feature of the present invention a third abutment is provided on the locking plate having a path of movement which is alined with the slot 60 and which is faced in the same direction as the second abutment but arcuately spaced from the latter so that, as the locking plate is subsequently returned to its free position, the third abutment shifts the finger back into a position opposite the shallow notch, so that when the actuator is de-energized the finger is free to drop back into idle position. Thus the locking plate is provided with a third abutment 77 having a path of movement 78 which, as shown in FIG. 2, is alined with the slot 60, so that when the operating lever 30 is completing the swing back to free position the finger 65 is engaged (FIG. 6) and shifted to the right (FIG. 6*a*) so that the finger 65 is opposite the shallow notch 61. The subsequent de-energization of the solenoid causes the spring 69 to thrust the rod 66 forwardly causing the finger 65 at the end thereof to be seated, in idle position, in the shallow notch as illustrated in FIG. 1.

While the present invention is not limited to any particular type of control circuit, a simplified form of control circuit has been illustrated in FIG. 1. The circuit includes a pushbutton control 80 having contacts 81, 82 connected in series with solenoid 68. Interposed in the circuit is a high temperature thermostat 83 coupled to the oven cavity and having a contact 84 which is closed under normal temperature conditions but which opens as the temperature approaches the pyrolytic level; for example, the contact 84 may open with a temperature of 600° is exceeded in the oven cavity. Also interposed in the solenoid circuit is a "door closed" switch 85 which is open when the door is open and which makes contact when the door is closed. Current may be supplied to the terminals 86 of the circuit from any convenient source.

Particularly where the door latch assembly is used with an oven having a source of microwaves, a normally open switch 90 may be provided on the mounting plate in the path of movement of the edge 91 of the locking plate 40, the switch being closed when the operating lever 30 is swung fully to bolting position. The switch 90 is connected in series with a door closed switch 92 for controlling the microwave power supply 93 which has a manual switch 94 converted in series relation. The door is then interlocked by the switch 85 and switch 92 for maximum safety during pyrolytic cleaning and microwave usage.

The manner in which the control circuitry is integrated with the operation of a latch assembly may be more completely understood by considering typical modes of operation. During conventional baking and broiling the operating lever may be left in its left-hand or free position as illustrated in FIG. 1, with the special features of the latch assembly inoperative.

However for microwave cookery it is necessary to swing the operating lever 30 to its right-hand, or bolted, position as illustrated in FIG. 2. Under such conditions the locking finger or pawl 65 remains idle, but the switch 90 is closed. Assuming that the door is in closed position, the door interlock switch 92 will also be closed so that the microwave supply may now be turned on by throwing switch 94 to complete the circuit. Any attempt to open the oven door while the microwave energy is turned on will be doubly defeated by opening of switch 90 followed by opening of switch 92.

For operation of the oven in its third or pyrolytic mode for self-cleaning, the oven door is closed, closing the door switch 85. Assuming that the temperature is at a low level, thermostat 83 will be in closed condition, thereby completing the pushbutton circuit. Pressing the pushbutton (FIG. 1) causes the solenoid 68 to be energized, pulling the locking finger, against the force of spring 69, into a shiftable position in the slot 60. While the user continues to hold the pushbutton depressed, the operating lever 30 is swung from its free to its bolting position, causing the locking finger 65 to be shifted to the position illustrated in FIG. 4*a* in which the finger is opposite the deep notch 62. Upon release of the pushbutton, the locking finger 65 drops into the root of the deep notch as illustrated in FIG. 5, in which position it is blockingly in the path of movement of the second abutment 75 so that the door cannot be opened. As the temperature in the cavity increases (heating element not shown) to a level approaching that required for pyrolitic cleaning, the thermostat 83 opens, thereby to disable the pushbutton 80. As a result the self-cleaning cycle must run its course, i.e., the temperature must be lowered, before access may be had to the oven cavity.

At the end of a predetermined time interval, after cleaning has taken place, the thermal heating elements in the cavity are turned off (by means not shown) and the temperature gradually drops to a safe level, at which time contact is again made by the thermostat 83. Since pushbutton 80 is no longer disabled, pressing the pushbutton energizes the solenoid 68 to lift the locking finger 65 from the deep notch as shown in FIG. 6 permitting the operating lever to be fully swung to its free position, shifting the finger 65, as shown in FIG. 6*a*, to a position opposite the shallow notch 61. Subsequent release of the pushbutton drops the finger into idle position in the notch 61, thereby restoring the parts to the condition illustrated in FIG. 1.

It will be apparent that the construction of the latching assembly, in its preferred form, is extremely simple, the only two moving parts, other than the operating lever, being the locking plate 40 and the locking rod 66 with its locking finger 65. Because of the simplicity of the assembly it is highly economical and reliable. The locking plate is moved positively under the control of the lever 30 without relying upon springs or the like and operation is therefore assured in spite of the gummy deposit which may accumulate upon the parts as a result of extended heavy usage of the oven. Shifting of the locking finger 65 is equally positive. With regard to movement of the locking finger in and out of the notches it will be noted that the locking finger is not closely fitted but is, on the contrary, loosely contained in the slot 60 so that it is not subject to gumming up; this insures that it will always be reliably operated by the forces available in the solenoid 68 and spring 69.

It will be understood that the term "mounting plate" as used herein refers to any supporting member. It will further be understood that the invention is not limited to a construction in which the bolt 23 is integral with the locking plate 40 and in a less preferred construction the bolt 23 may be integral with a bolt plate which lies side-by-side with the locking plate 40 and with the operating lever being connected to the bolt plate rather than to the locking plate. Thus when reference is made to a pivot connection between the operating lever and the locking plate it will be understood that this includes a direct pivot connection, for example as provided by the pivot 36 in the present construction, or an indirect pivot connection where more than one pivot may be involved arranged in series force-transmitting relation. Further, reference has been made to the presence of the abutments 71, 75 and 77 as being "on" the locking plate. While it is, indeed, one of the features of the preferred construction that all such abutments are directly and integrally formed on the locking plate, the term on is not limited thereto, and the term is intended to include any abutment which is connected or coupled to the operating plate so as to be moved in unison therewith.

Solenoid 68 and return spring 69 have been disclosed to provide movement of the finger 65 into and out of the notches, but it will be understood that the invention is not limited thereto and the positions or functions of the solenoid and spring may be interchanged; indeed, a double acting actuator may be used if desired. Thus the term "energized" or "biased" are relative terms and will be understood simply to mean one of the two possible conditions of the actuator, regardless of whether the actuator is or is not in a normally powered state.

The term "slot" and the term "notch" have been used for convenience, and, in the structure as shown, they are fully defined by an opening of "C" shape in the mounting plate. However, it will be understood that the terms are intended primarily to define a path of movement and thus, if the excursion of the solenoid is limited to the range shown in the drawings, the edge 60*a* of the slot may be omitted, if desired, along with the lateral edges 61*a*, 62*a* of the notches, without departing from the invention.

While the invention has particular application to a self-cleaning oven of the pyrolytic type, and even more particular application to a common cavity oven including a source of microwaves, it will be apparent that use of the latch is not limited to such applications and that the latch can be used in any environment in which it is desirable to maintain a door positively locked for the duration of a hazardous condition.

What I claim is:

1. In a door latch assembly for a pyrolytic self-cleaning oven or the like for cooperating with a striker on the oven door, the combination comprising a mounting plate having means for securing to the oven frame, a locking plate movable thereon, a hook-type bolt coupled to the locking plate for movement therewith, an operating handle coupled to the locking plate for bodily moving the locking plate and its bolt between free and bolting positions, means fixed to the mounting plate defining a short slot adjacent the locking plate and oriented in the direction of movement of the adjacent portion of the locking plate, the slot having a shallow "idle" notch and deep "locking" notch spaced parallel to one another at right angles to the slot, a locking finger shiftable endwise in the slot and biased toward the notches, an actuator coupled to the locking finger so arranged that when the actuator is energized the locking finger is drawn into a shiftable position in the slot clear of the notches, a first abutment on the locking plate having a path of movement alined with the slot but clear of the notches so that (a) when the actuator is de-energized and the finger occupies an idle position in the shallow notch the locking plate and bolt are freely movable by the operating handle between free and bolting positions and so that (b) when the actuator is energized the finger is drawn into the slot in the path of movement of the first abutment with the result that, as the locking plate is moved fully into bolting position, the first abutment moves the finger to a position opposite the deep notch, a second abutment on the locking plate faced oppositely to the first abutment and having a path of movement alined with the root of the deep notch so that when the actuator is de-energized the finger drops by reason of the force of bias into the deep notch blocking the locking plate, and thus the bolt, in bolting position until such time as the actuator may be re-energized, and a third abutment on the locking plate having a path of movement aline with the slot and faced in the same direction as the second abutment and spaced from the latter so that, as the locking plate is subsequently returned to its free position, the third abutment shifts the finger into a position opposite the shallow notch, thereby permitting the finger to drop back into idle position when the actuator is thereafter de-energized.

2. In a door latch assembly for a pyrolytic self-cleaning oven or the like for cooperating with a striker on the oven door, the combination comprising a mounting plate having means for securing to the oven frame, a locking plate movable thereon, a hook-type bolt coupled to the locking plate for movement therewith, an operating lever fulcrumed on the mounting plate and having a pivot connection with the locking plate for bodily moving the locking plate and its bolt between free and bolting positions, means fixed to the mounting plate defining a short slot adjacent the locking plate and oriented in the direction of movement of the adjacent portion of the locking plate, the slot having a shallow idle notch and a relatively deep locking notch spaced parallel to one another at right angles to the slot, a locking finger shiftable endwise in the slot and biased toward the notches, an actuator coupled to the locking finger so that when the actuator is energized the locking finger is drawn into the slot into a shiftable position clear of the notches, a first abutment on the locking plate having a path of movement alined with the slot but clear of the notches so that (a) when the actuator is de-energized and the finger occupies an idle position in the shallow notch the locking plate and bolt are freely movable by the operating lever between free and bolting positions and so that (b) when the actuator is energized the finger is drawn into the slot into the path of movement of the first abutment with the result that, as the locking plate is moved fully into bolting position, the first abutment thereon moves the finger to a position opposite the deep notch, a second abutment on the locking plate faced oppositely to the first abutment and having a path of movement alined with the root of the deep notch so that when the actuator is de-energized the finger drops by reason of the force of bias into the deep notch blocking the locking plate, and thus the bolt, in bolting position until such time as the actuator may be re-energized, and a third abutment on the locking plate faced in the same direction is the second abutment and having a path of movement alined with the seat so that as the locking plate is subsequently returned to free position the third abutment shifts the finger into a position opposite the shallow notch, thereby permitting the finger to drop back into idle position in the shallow notch when the actuator is thereafter de-energized.

3. In a door latch assembly for a pyrolytic self-cleaning oven for cooperating with a striker on the door, the combination comprising a mounting plate having means for securing to the oven frame, a locking plate movable thereon, a hook-type bolt coupled to the locking plate for movement therewith, an operating lever fulcrumed on the mounting plate, the operating lever having a pivot connection with the locking plate for bodily moving the locking plate and its bolt between free and bolting positions, a cam and cam follower interposed between the mounting plate and the locking plate to modify the movement of the latter so that as the operating lever is manually operated the locking plate swings the bolt against the striker and then pulls the bolt in upon the striker to close the door tightly, means fixed to the mounting plate defining a short slot adjacent the locking plate and oriented along the direction of movement of the locking plate, the slot having a shallow idle notch and a relatively deep locking notch spaced parallel to one another at right angles to the slot, a locking finger shiftable endwise in the slot and biased toward the notches, an actuator connected to the locking finger so that when the actuator is energized the locking finger is drawn into a shiftable position in the slot clear of the notches, a first abutment on the locking plate having a path of movement alined with the slot but clear of the notches so that (a) when the actuator is de-energized and the finger occupies an idle position in the shallow notch the locking plate and bolt are freely movable between free and bolting positions and so that (b) when the actuator is energized the finger is drawn into the path of movement of the first abutment with the result that the first abutment moves the finger to a position alined with the deep notch as the locking plate moves fully into bolting position, disabling means responsive to a high oven temperature for disabling the actuator during a pyrolytic cleaning cycle, a second oppositely facing abutment on the locking plate having a path of movement alined with the root of the deep notch so that when the actuator is de-energized by the disabling means the finger drops by reason of the force of bias into the deep notch blocking the locking plate, and thus the bolt, in bolting position until such time as the oven temperature is reduced, and means operated incident to subsequent energization of the actuator for restoring the finger to its idle position.

4. In a door latch assembly for a pyrolytic self-cleaning oven or the like for cooperating with a striker on the oven door, the combination comprising a mounting plate having means for securing to the oven frame, a locking plate movable thereon, a hook-type bolt coupled to the locking plate for movement therewith, an operating handle coupled to the locking plate for bodily moving the locking plate and its bolt between free and bolting positions, means fixed to the mounting plate defining a short slot adjacent the locking plate and oriented in the direction of movement of the adjacent portion of the mounting plate, the slot having a shallow idle notch and a deep locking notch spaced parallel to one another at right angles to the slot, a locking finger shiftable endwise in the slot, an actuator coupled to the locking finger so arranged that when the actuator is energized the locking finger is drawn into a shiftable position in the slot clear of the notches, the locking plate having a first abutment alined with the slot for engaging the finger and for moving the finger to a position opposite the deep notch as the locking plate is moved into bolted position, the locking plate having a second abutment faced oppositely to the first abutment and having a path of movement alined with the root of the deep notch so that when the finger moves into the latter the locking plate, and thus the bolt, are blocked in the bolting position, and means operated incident to subsequent re-energization of the actuator for restoring the finger to its idle position.

5. In a door latch assembly for a pyrolytic self-cleaning oven having a high temperature responsive disabling means and for cooperating with a striker on the oven door, the combination comprising a mounting plate having means for securing to the oven frame, a locking plate movable thereon, a hook-type bolt secured to the front edge of the locking plate, an operating handle movable on the mounting plate, and connected to the locking plate for bodily moving the locking plate and bolt between free and bolting positions, means fixed to the mounting plate defining a short slot arranged adjacent the rear edge of the locking plate and oriented in the direction of movement of such rear edge, the slot having a shallow idle notch and a relatively deep locking notch spaced parallel to one another at right angles to the slot, a locking finger shiftable endwise in the slot and biased toward the notches, an actuator connected to the locking finger for moving the same so that when the actuator is energized the locking finger is drawn into the slot to a shiftable position clear of the notches, a first abutment on the locking plate having a path of movement alined with the slot but clearing the notches so that (a) when the actuator is de-energized and the finger occupies an idle position in the shallow notch the locking plate is freely movable between its free and bolting positions and so that (b) when the actuator is energized the finger is drawn into the slot into the path of movement of the first abutment with the result that, as the locking plate is moved fully into bolting position, the first abutment moves the finger to a position alined with the deep notch, and a second, oppositely facing, abutment on the locking plate having a path of movement alined with the root of the deep notch so that when the actuator is de-energized the finger drops by reason of the force of bias into the deep notch blocking the locking plate and thus the bolt, in bolting position until such time as the actuator is again energized.

6. The combination as claimed in claim 5 in which the actuator is connected to the disabling means to prevent the actuator from being re-energized as long as a high temperature exists in the oven.

7. The combination as claimed in claim 5 in which a restoring member is provided movable with the locking plate as the same is subsequently returned to its free position for shifting the finger in the reverse direction in the slot into a position alined with the shallow notch thereby permitting the finger to drop back into idle position in the shallow notch when the actuator is thereafter de-energized.

8. In a door latch assembly for a pyrolytic self-cleaning oven having high temperature responsive disabling means and for cooperating with a striker on the door, the combination comprising a mounting plate having means for securing to the oven frame, a locking plate movable thereon, a hook-type bolt secured to the front edge of the locking plate, an operating handle movable on the mounting plate and connected to the locking plate for bodily moving the locking plate and bolt between free and bolting positions, a cam and cam follower interposed between the mounting plate and the locking plate to modify movement of the latter so that as the operating handle is manually moved the locking plate swings the bolt against the striker and then pulls the bolt in to close the door tightly, means fixed to the mounting plate defining a short slot arranged adjacent the rear edge of the locking plate and oriented along the path of movement of the rear edge, the slot having a shallow idle notch and a relatively deep locking notch extending parallel to one another at right angles to the slot, a locking finger shiftable endwise in the slot and biased toward the notches, an actuator connected to the locking finger for moving the same so that when the actuator is energized the locking finger is drawn into the slot and clear of the notches, a first abutment on the rear edge of the locking plate having a path of movement alined with the slot but clearing the notches so that (a) when the actuator is de-energized and the finger occupies an idle position in the shallow notch the locking plate is freely movable between its free and bolting positions and so that (b) when the actuator is energized the finger is drawn into the slot into the path of movement of the first abutment with the result that, as the locking plate is moved fully into bolting position, the first abutment thereon moves the finger to a position alined with the deep notch, a second, oppositely facing, abutment on the locking plate having a path of movement alined with the root of the deep notch so that when the actuator is de-energized the finger drops by reason of the force of bias into the deep notch blocking the locking plate, and thus the bolt, in bolting position until such time as the actuator is again energized, and means operated incident to subsequent energization of the actuator for restoring the finger to its idle position.

* * * * *